US005150476A

United States Patent [19]

Statham et al.

[11] Patent Number: 5,150,476

[45] Date of Patent: Sep. 29, 1992

[54] INSULATING FABRIC AND METHOD OF PRODUCING SAME

[75] Inventors: Denise N. Statham, Powder Springs; Michael T. Stanhope, Atlanta; Thomas J. Hejhal, Dunwoody, all of Ga.

[73] Assignee: Southern Mills, Inc., Union City, Ga.

[21] Appl. No.: 673,950

[22] Filed: Mar. 22, 1991

[51] Int. Cl.[5] ..... A41D 13/00

[52] U.S. Cl. ..... 2/93; 2/81; 2/82; 2/85; 2/97; 2/243 A; 2/243 R; 2/272

[58] Field of Search ..... 2/93, 81, 82, 87, 85, 2/69, 79, 97, 243 A, 243 R, 272; 428/166, 178, 920, 921

[56] References Cited

U.S. PATENT DOCUMENTS

| | | | |
|---|---|---|---|
| 3,710,395 | 1/1973 | Spano et al. . | |
| 4,034,417 | 7/1977 | Ellis . | |
| 4,039,709 | 8/1977 | Newman . | |
| 4,395,453 | 7/1983 | Lines, Jr. et al. . | |
| 4,451,934 | 6/1984 | Gioello . | |
| 4,502,153 | 3/1985 | Lapedes et al. . | |
| 4,604,759 | 8/1986 | Bowman et al. . | |
| 4,709,421 | 12/1987 | Grilliot et al. . | |
| 4,748,691 | 6/1988 | Grilliot et al. . | |
| 4,830,897 | 5/1989 | Lichtenstein . | |
| 4,843,646 | 7/1989 | Grilliot et al. | 2/93 |
| 4,897,886 | 2/1990 | Grilliot et al. | 2/93 |
| 5,001,781 | 3/1991 | Grilliot et al. | 2/81 |
| 5,001,783 | 3/1991 | Grilliot et al. | 2/81 |

*Primary Examiner*—Werner H. Schroeder
*Assistant Examiner*—Gloria Hale
*Attorney, Agent, or Firm*—Hopkins & Thomas

[57] ABSTRACT

A layered insulating fabric (11) for use as a lining for protective garments (34) of the type commonly worn by fire fighters comprises an intermediate layer (14) of pleated material sandwiched between face (12) and inner (13) layers of material. The inner, pleated, and face layers are secured together by lines of stitching (16), which maintain the intermediate layer in position and in its pleated configuration. The pleats of the intermediate layer maintain the inner and face layers in spaced relationship and define therebetween an array of air pockets (19) that function as thermal insulation. The pleats also function to wick moisture away from the face layer and toward the inner layer to help keep a wearer dry.

21 Claims, 2 Drawing Sheets

INSULATING FABRIC AND METHOD OF PRODUCING SAME

TECHNICAL FIELD

This invention relates to textile fabrics and particularly to thermally insulating fabrics of the type from which, for example, linings of the protective garments of fire fighters can be produced.

BACKGROUND OF THE INVENTION

Fabrics with good thermal insulation and other protective qualities have in recent years found a variety of advantageous applications including use in insulating curtains, wall covering, winter apparel and the like. Probably the most critical and demanding use of such insulating fabrics, however, has been as the interior lining for the protective clothing of fire fighters. Such protective clothing, commonly known as fire fighter's turnout suits, and the lining of such clothing can be and often is subjected to the dangerous extremes of heat, open flame, smoke, steam and corrosive fumes commonly generated within a residential or commercial fire. Typically the turnout suits include an outer layer or "shell" of flame and abrasive resistant material, an intermediate layer of moisture barrier material and the inner thermal liner which is positioned adjacent the body of the wearer. Obviously, the fabric from which the lining of such garments is produced must be able to withstand these extreme external conditions while simultaneously keeping a fire fighter relatively cool and dry and also unincumbered by the weight of the fabric itself.

Attempts have been made to provide insulating fabrics for use as liners in protective turnout suits that satisfy the grueling demands of protection against the harsh environment of a fire while simultaneously meeting the somewhat opposing requirements that the liner be light in weight and relatively cool and dry for the wearer. Examples of such attempts include the provision of multiply fabric liners having a flame resistant woven face layer which faces the wearer and an attached layer of a thermally insulating batt material such as Nomex or Kevlar which is positioned adjacent the moisture barrier material and the outer shell material of the garment. Neoprene and other polymeric materials coated onto such insulating batts also have been used because of the water resistant properties of the rubber coating.

While such layered and coated batted fabrics have proven somewhat successful when used in firemen's protective clothing, they nevertheless have included problems and shortcomings inherent in their respective designs. The insulative batts of these fabrics, for example, tend to retain body heat and moisture within the garment and can thus become unbearably hot and humid for a wearer. Perhaps the greatest problem with such inner liner fabrics, however, has been their excess weight for a given degree of protection against hostile environments. Therefore, in the production of fire fighter's garments as well as in some other products, a compromise has been required between the competing requirements of adequate heat insulation and lightest possible weight.

Specific examples of fabrics previously used as liners for fire fighter's protective garments are disclosed in U.S. Pat. Nos. 4,897,889 of Grilliot, 4,830,897 of Lichtenstein, 4,034,417 of Ellis, and 4,502,153 of Lapedes, et al. While these examples may represent improvements over older protective fabrics, they tend to be heavy and expensive to produce and still include at least some of the problems discussed above. Therefore, a continuing need exists for a heat insulating fabric for use in protective garments and other products that is economical to produce and that exhibits superior protection against the hostile environments of a fire, while being light in weight, relatively cool to the wearer, and resistant to the build up of moisture within the garment. The present invention comprises such a fabric as well as the method of producing same and a garment incorporating the fabric.

SUMMARY OF THE INVENTION

This invention comprises a protective fabric for use as heat insulating material, particularly as a thermal inner liner in garments such as fire fighter's turn-out suits. In one preferred embodiment, the thermal liner includes a face layer of woven cloth or material that is flame and fire resistant with good moisture transport properties and an inner layer of nonwoven material that is thin and light and is thermally insulative and moisture absorbent. Sandwiched between the inner and face layers of materials is an intermediate layer of material that is formed into a pleated configuration that generally functions to hold the face and inner layers of materials apart. The intermediate layer can be made of the same material as the inner layer if desired.

The inner, face, and intermediate layers are secured together by spaced lines of stitching that extend through and secure all three layers together. The lines of stitching, which can be widely spaced in a quilted pattern, preferably are applied to define a multitude of contiguous regions of the thermal liner with each region being bounded by adjacent lines of stitching. With this configuration, the pleated intermediate layer of material maintains the inner and face layers of materials in mutually spaced relationship within each of the contiguous bounded regions of the fabric and defines between the spaced layers within each region a plurality of static air pockets that extend along the folds of the pleated intermediate layer. The configuration and placement of the stitching maintains the intermediate layer securely in place between the inner and face layers to insure the integrity and longevity of its pleated configuration even during otherwise abusive treatment and washing.

In another embodiment of the invention the thermal liner comprises only two layers of material, the woven face material and the nonwoven pleated material, with the layers being sewn together at spaced lines of stitching. Although the inner layer of material is absent from the fabric, this embodiment of the invention would be used where there is another layer of material used adjacent the pleated material. For example, in a turnout suit the next layer of the garment typically is the moisture barrier material which lies closely adjacent the pleated layer so as to trap air between the pleats of the intermediate layer.

Protective garments that include one of the just described embodiments of thermal liner fabrics as a liner of the garment have been found to exhibit thermal insulation and protective qualities equalling or surpassing those of garments that incorporate prior art protective fabrics. Further, since primary insulation is provided by the static air spaces defined by the pleated intermediate layer, the fabric of this invention has a weight per area ratio substantially less than that of known prior art fabrics exhibiting comparable protection. Garments and other products incorporating the fabric of this invention therefore are significantly lighter and less burdensome than equally thermally insulated products produced with fabrics of the past.

In addition, with properly chosen materials, moisture on adjacent surfaces such as a wearer's body is initially absorbed into the face layer of the liner fabric and then wicked away from the face layer and into the material of the pleated layer. The moisture then can be dissipated as water vapor through the inner layer of liner fabric, depending on the nature of the next adjacent layers of the garment, and possibly other conditions. Thus, protective garments incorporating the fabric of the present invention are highly protective yet lighter and dryer than suits of the known prior-art fabrics.

The simple design of the heat insulating fabric makes it extremely economical to manufacture the fabric in mass quantities with low skilled labor and the light weight of the fabric makes it easy to handle when being formed into a garment or other end use product.

It is therefore an object of this invention to provide a fabric for use in garments and other products that is highly protective against the hostile environments of a fire.

A further object of the invention is to provide a heat insulating fabric that is lightweight for producing lighter heat insulating garments and other heat insulating products.

Another object of the invention is to provide a fabric for protective garments that draws moisture away from a wearer to maintain a dry condition within the garment.

An additional object of the invention is to provide an efficient and economical method of producing a fabric of the type described.

A further object of the invention is to provide a light weight turn-out suit for fire fighters that incorporates the insulative fabric of the present invention as a liner.

These and other objects, features, and advantages of the invention will become more apparent upon review of the following detailed description when taken in conjunction with the accompanying drawings.

DETAILED DESCRIPTION OF THE PREFERRED EMBODIMENTS

Figure 1:
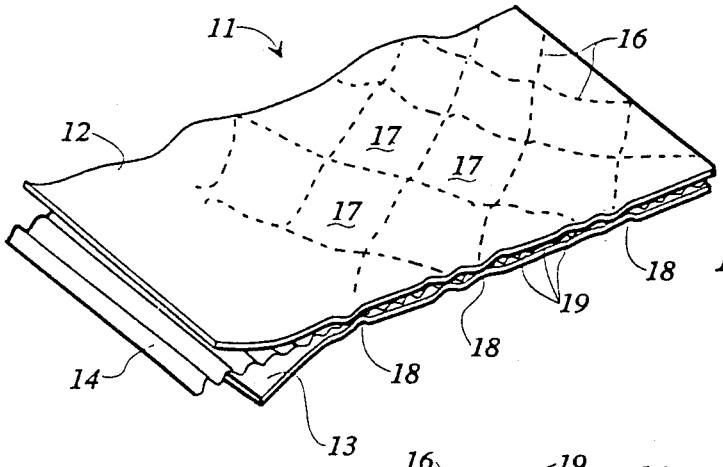
FIG. 1 is a perspective view of a fabric that embodies principles of the invention in a preferred form with a portion of the fabric separated to show the individual layers thereof.

Referring now in more detail to the drawings, in which like numerals refer to like parts throughout the several views, FIG. 1 shows the basic construction of a lightweight insulating protective fabric that embodies principles of the present invention in a preferred form. The fabric 11 comprises an outer layer of material 12 known as the "face" layer of material and an inner layer of material 13. Sandwiched between the outer and inner layers of material is an intermediate layer of material 14 that is deformed into a corrugated or pleated configuration.

The face, inner, and intermediate layers of material are secured together by lines of stitching 16 that extend through all layers. The lines of stitching can be applied along a plurality of paths in a quilted pattern if desired with the quilted pattern preferably defining a number of contiguous and substantially bounded regions 17 of the fabric 11. The tension of the stitching 16 is preferably sufficient to collapse at least partially the pleated intermediate layer 14 between the face and inner layers 12 and 13 along the lines of stitching as illustrated at 18. However, the intermediate pleated layer of material maintains its open pleated configuration in the regions between the lines of stitching.

Figure 4:
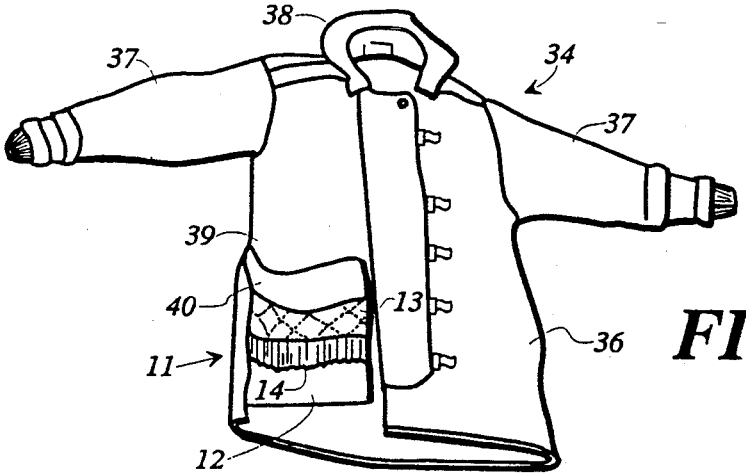
FIG. 4 is a perspective partially cut-away view of a fire fighter's turnout coat that embodies the fabric of FIG. 1 as an inner liner.

While the fabric of this invention may find many advantageous uses such as material for insulating curtains, wall covering, winter apparel, and the like, it has been found to be particularly suitable as an inner liner for protective garments 34 (FIG. 4) known as turnout suits that are used by firefighters when fighting residential or commercial fires. The turnout suits typically comprise an outer shell 39 that is heat and abrasive resistant, a moisture barrier 40 as the next inner layer, and an inner liner. FIG. 4 illustrates the turnout jacket with the inner liner fabric 11 of FIGS. 1 and 2. For this application, it is highly desirable that the inner liner 11 include as its face material a material that is resistant to open flame and have good moisture transport properties. While many materials might exhibit these properties and thus be suitable for use as the face layer 12, it has been found that a commercially available woven Nomex material is particularly desirable because of its high resistance to harsh environments and its light weight.

The materials of the inner layer 13 and the pleated intermediate layer 14 can be the same as each other if desired. Further, these materials preferably are moisture absorbent for drawing moisture away from the face material and away from a wearer as described in more detail below. Such material preferably exhibits some insulative qualities of its own. It has been found that a nonwoven aramid liner material is particularly desirable for the inner and intermediate layers because of its insulative and moisture absorbent qualities and because it tends to hold a deformed pleated pattern for a sufficient time to allow it to be moved between the inner and face layers of material and stitched in place shortly after having been subjected to the deforming process.

While preferred materials have been suggested for the face, intermediate, and inner layers of the fabric, it should be understood that the three layers might consist of materials chosen from a wide range of possibilities. Material choices might, for example, be made from the group consisting of meta-aramid, other aramids, polynosic rayon, flame resistant polynosic rayon, viscose rayon, flame resistant viscose rayon, other flame resistant cellulosics such as cotton or acetate, cotton, flame resistant polyester, polybenzimidazole, polyvinyl alcohol, polytetrafluoroethylene, wool, flame resistant wool, polyvinyl chloride, polyetheretherketone, polyetherimide, polyethersulfone, polychlal, polyimide, polyamide, polyimide-amide, polyolefin, carbon, modacrylic, acrylic, melamine, and glass. Additional materials for use as the pleated intermediate layer 14 of the fabric 11 and possibly also the inner layer 13 include knits, nonwovens, wovens, stitch-bonded fabrics, and weft-insertion fabrics. Other suitable materials might also be selected consistent with the spirit and scope of the present invention depending upon the particular intended use of the fabric.

Figure 2:
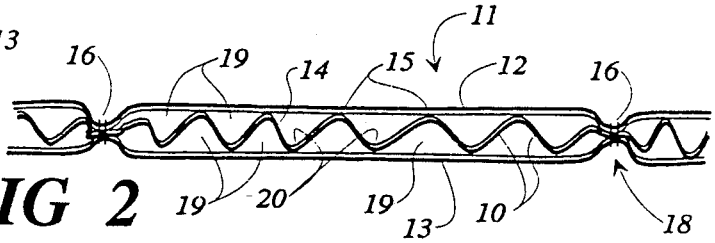
FIG. 2 is a side sectional view of the fabric of FIG. 1 showing the spacial configurations and relationships of the various layers.

FIG. 2 is an enlarged sectional side elevational view of the fabric of FIG. 1 showing the spacial configurations and interrelationships of the various layers of the fabric. The intermediate layer 14 is seen to be deformed into a sinuous pleated or corrugated configuration having spaced ridges 15, which bear against the face layer of material 12, spaced troughs 20, which bear against the inner layer of material 13, and legs 10 that extend between adjacent ridges and troughs. With this configuration, the pleated intermediate layer 14 tends to urge the face and inner layers 12 and 13 into mutually spaced substantially parallel relationship with respect to each other. Furthermore, the legs 10 of the pleated intermediate layer 14 define between the inner and outer layers a plurality of adjacent elongated channels 19.

As best illustrated in FIG. 1, the elongated channels 19 defined by the legs of the pleated intermediate layer 14 are closed at intervals along their length by the lines of stitching 16 that define the contiguous bounded regions 17 in the fabric. In this way, the channels 19 within each bounded region are isolated from channels of adjacent regions to form a plurality of static air pockets within each region. The static air trapped within these pockets, then, provides excellent insulation against heat transfer between the face layer of material 12 and the inner layer of material 13 while contributing virtually no additional weight to a garment that incorporates the fabric. Insulation qualities equalling or exceeding those of batt materials of the past can thus be achieved with material having substantially less weight than such batt materials.

As previously discussed, the face, intermediate, and inner layers of material are securely bound together by lines of stitching 16 that extend through all three layers of the fabric and that preferably is configured in a quilted pattern defining contiguous regions 17 of the fabric 11. As best seen in FIG. 2, the tension applied to the stitching as it is sewn through the layers of material preferably is sufficient to collapse the pleated intermediate layer between the outer and inner layers along the lines of stitching as illustrated at 18. However, the stitching can be loose to avoid collapse of the intermediate layer and thus maintain maximum spacing between the inner and outer layers, if desired.

The stitching 16 functions to maintain the pleated intermediate layer 14 securely in position between the face and inner layers 12 and 13 and thus preserves its deformed configuration by preventing the material of the intermediate layer from stretching out or bunching together as a garment is worn and washed. The quilted stitching pattern thus preserves the integrity of the pleats formed in the intermediate layer material so that the spacing between the face and inner layers and the air pockets defined therebetween are maintained throughout normal use and cleaning conditions. In this way, the fabric retains its insulative qualities even after long use of a garment in which it is used. The stitching further serves to isolate the channels 19 within each of the bounded regions 17 from corresponding channels in adjacent bounded regions. This isolation creates a plurality of individual air pockets within each of the contiguous bounded regions thus increasing the degree of thermal insulation provided by the fabric.

As mentioned briefly above, the material from which the inner and intermediate layers 13 and 14 are formed can be the same if desired and is preferably moisture absorbent with some insulation qualities of its own. In this way, a wearer of a garment such as the turnout jacket of FIG. 4 having the fabric of this invention as a liner positioned adjacent the body of the wearer is not only insulated from heat and flame by the fabric, the inner and intermediate layers 13 and 14 of the fabric also tend to draw moisture away from the face material 12 and therefore from the wearer's body to help keep him dry when fighting a fire. Specifically, with the inner and intermediate layers being, for example, non-woven Nomex, perspiration and other moisture within the garment tends to be transported through the face layer 12. This moisture then tends to be drawn from the face layer 12 into the material of the intermediate pleated layer 14 along the lines of contact between the troughs 20 of the pleats and the face layer of material 12. Later, after the garment has been used and is to be dried, this moisture is then wicked along the legs 10 of the pleats toward the face material 12, where the moisture can be dissipated from the face layer in the form of water vapor.

Thus, a fire fighter's garment 34 incorporating the fabric of this invention is not only light and highly protective, it also tends to draw moisture away from a firefighter's body to keep him cool while fighting a fire. The wicking of moisture away from a wearer's body through the face material 12 and into the pleated intermediate layer 14 and toward the inner layer 13 of the liner is believed will reduce the risk of steam burns that can sometimes occur when fighting a fire.

The size and number of pleats captured within each of the bounded regions of the fabric can have an impact on the overall efficiency and characteristics of the fabric. For example, pleats that have heights of between $\frac{1}{8}''$ and 3" might be chosen depending upon the intended end use of the fabric. However, for use as the lining of fire fighter's protective clothing, pleats having leg lengths of between $\frac{1}{8}''$ and $\frac{1}{4}''$ in combination with quilted bounded regions of approximately 4 square inches have been found to provide a high degree of heat insulation with minimum weight and maximum moisture dissipation. With these dimensions, an average spacing between the inner and outer layers of material of between 0.088 and 0.177 inches is provided.

The intermediate layer of material 14 has been illustrated as being deformed into an accordion folded or pleated pattern. It should be understood, however, that the present invention is not limited to such a pattern and that various alternate deformations of the intermediate layer 14 might be selected to facilitate ease of movement and improved comfort for the wearer. Examples of methods usable to form such alternative deformations include embossing, napping, pattern needling, recessing, sanding, perforating, or flocking. The pleated pattern illustrated in the preferred embodiment should therefore not be considered a limitation of the invention but rather only a preferred configuration that has been found to function well in linings for protective garments. Furthermore, the layers of the fabric also might be secured together by means other than lines of stitching such as, for example, lamination or bonding.

Figure 3:
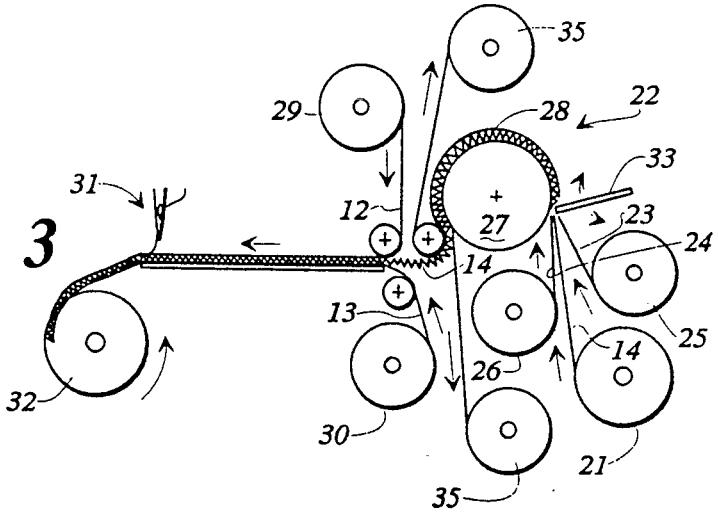
FIG. 3 is a functional schematic illustration of a preferred method of producing the fabric of FIG. 1.

FIG. 3 illustrates a preferred method or process for manufacturing fabric of the present invention. In the process, material for the intermediate layer 14 is drawn from a supply 21 and moved along a first path through a pleating apparatus 22, which deforms the material into a pleated configuration. Layers of kraft paper 23 and 24 are drawn from supplies 25 and 26 and are progressively fed to opposite sides of layer of intermediate material 14 and the three layers of material are progressively pleated together by the pleating apparatus, so that the relatively fragile intermediate material, such as spun lace aramid, is protected on both surfaces by the abutting layers of kraft paper. The pleating is performed in conventional manner by an oscillating pleating plate 33 gathering short lengths of the kraft paper and intermediate material against the surface of the heated roll 27 and urging the folds of material beneath the hood 28. The kraft paper and intermediate layer of material are heated by the heated roll 27 and its arcuate hood 28, which assists in forming and maintaining the folds of the kraft paper and of the intermediate layer of material.

When the folded layers of kraft paper and intermediate layer of material emerge from the arcuate hood 28 of the pleating apparatus 22, the kraft paper is pulled away from the pleated intermediate layer of material by rolls 28 and 29, leaving the intermediate layer of material in its accordion folded configuration.

The deformed intermediate layer material continues to move along the process path to a position where outer or face layer material 12 and inner layer material 13, drawn from respective supplies 29 and 30, are moved into positions on opposite sides of the intermediate layer 14. The sandwiched materials are then moved together along a second path to a conventional quilting station 31, which stitches the layers together in a quilted pattern as disclosed above. The resulting fabric is then wound onto a take-up reel 32 for subsequent transport, storage, and further handling.

With the just described method, the various layers of the fabrics are brought and quilted securely together shortly after the intermediate layer has been deformed by the pleating apparatus 22. In this way, the crisp pattern of the intermediate layer is stitched into and substantially frozen within the fabric before the intermediate layer can relax. Deterioration of the pleats of the intermediate layer is thus avoided. The process of producing the fabric of this invention is therefore efficient, inexpensive and produces a superior fabric with the exceptional qualities ascribed above.

The spacing maintained between the outer and inner layers is greater than the thickness of the material from which the intermediate layer 14 is formed. In this way, the total weight of intermediate layer material required to maintain a given spacing between the inner and outer layers can be substantially less than the weight of insulative batts used in the past to maintain comparable spacing since such batts tend to fill the space completely.

FIG. 4 illustrates a fire fighter's protective garment that incorporates the fabric of this invention as an interior thermal liner or barrier. The illustrated garment is seen to comprise a protective coat 34 having a trunk portion 36, sleeves 37, and collar 38. The outer shell 39 of the coat 34 can be formed of a number of flame and abrasion resistant materials such as woven aramid or polybenzimidazole fabrics commonly used in the construction of such garments. The moisture barrier material 40 is next in from the outer shell 39 and the thermal inner liner 11 of FIGS. 1 and 2 is next. These layers of fabric are bound together at the edges of the garment.

Figure 6:
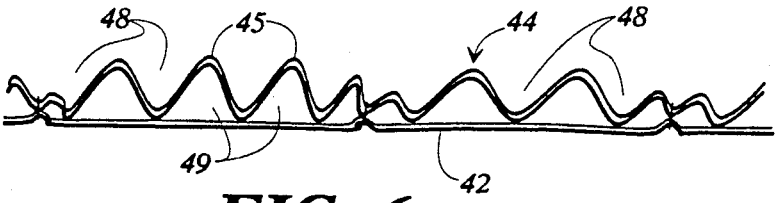
FIG. 6 is a side sectional view of the fabric of FIG. 5.
Figure 5:
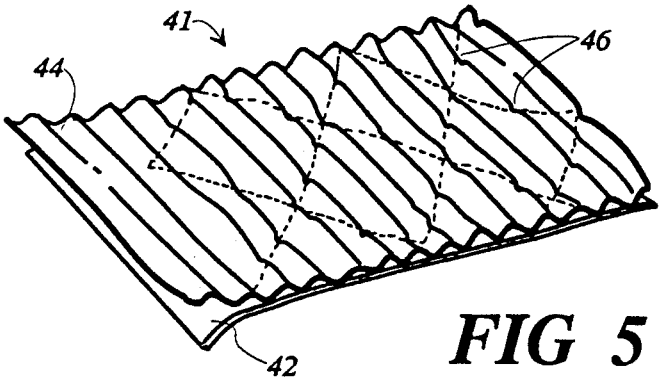
FIG. 5 is a perspective view of a fabric that is another embodiment of the invention, with a portion of the fabric separated to show the individual layers thereof.

FIGS. 5 and 6 illustrate a second form of the insulating fabric 41 which includes the outer or face layer of material 42, the intermediate layer of material 44, but no inner layer of material such as the layer 13 of FIG. 1. The intermediate layer is pleated, and the quilt stitching 46 is formed directly into the pleated layer 44, and through the face layer 42.

As shown in FIG. 6, the absence of an inner layer extending over the intermediate pleated layer 44 causes the ridges 45 of the intermediate layer to be exposed, so that closed air pockets 49 are formed only on one side of the intermediate pleated material 44. Open pockets 48 are formed on the other side of the fabric. However, it is anticipated that the fabric of FIG. 6 will be used in combination with a second fabric that faces the ridges 45, so that closed air pockets will be formed at 48 between the ridges 45 by the adjacent layer of material.

Figure 8:
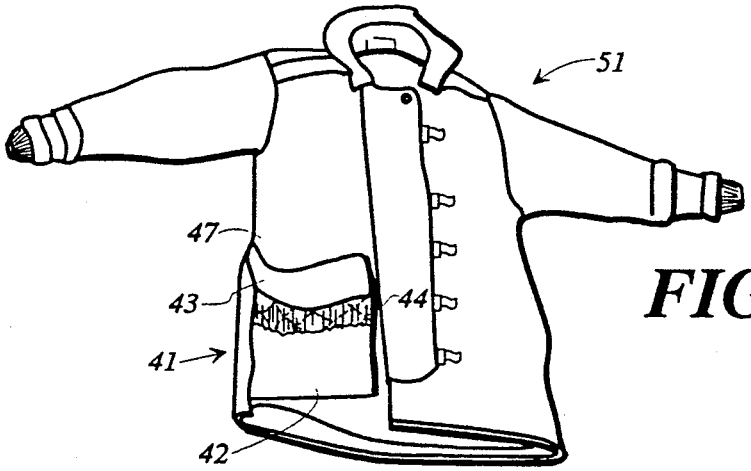
FIG. 8 is a perspective partially cut away view of a firefighter's turnout jacket which embodies the fabric of FIG. 5 as an inner liner.

For example, FIG. 8 shows a firefighter's turnout garment 51 which includes the insulating fabric 41 of FIGS. 5 and 6, which includes the face layer of material 42, and the pleated layer of material 44. The pleated layer of material is bounded by the moisture impermeable layer 43, and that layer is covered by the outer shell 47. The abutting facing surfaces of the moisture impermeable material 43 and the pleated material 44 tends to form gaps or static air spaces 48 (FIG. 6) in the garment.

Figure 7:
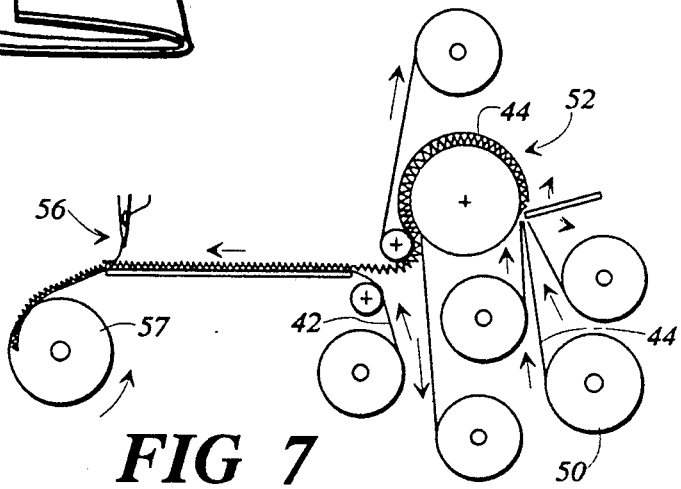
FIG. 7 is a schematic illustration of a method of producing the fabric of FIG. 5.

FIG. 7 illustrates the process for forming the inner liner fabric 41, which is similar to the process of FIG. 3. As with FIG. 3, the process of FIG. 7 includes advancing a length of the intermediate material 44 from a reel 50 into a pleating apparatus 52 of the type illustrated in FIG. 3 and as described above, so that the material is deformed with pleats and becomes the intermediate pleated material 44. The face material 42 moves into underlying relationship with respect to the pleated material 44, and the two materials are stitching together by quilting apparatus 56. The completed inner liner material is accumulated at 57.

The invention has been described herein in terms of preferred embodiments. It will be obvious to those of skill in the art, however, that various modifications, additions, and deletions might be made to the exemplary embodiments consistent with the breadth of the invention. For example, while the fabric has been described as comprising only three layers, obviously more layers could be provided with selected layers being pleated or otherwise deformed. In addition, some or all of the layers comprising the fabric could be formed of multiple plies of material according to specific requirements rather than the single ply material layers described herein. Finally, while the fabric has been described primarily with reference to its use as a liner for fire fighter's protective clothing, the fabric is obviously applicable to any type of garment or other product where insulative, moisture wicking, or fire retardant qualities are desirable. These and many other modifications, additions, and deletions might be made to the illustrated embodiments without departing from the spirit and scope of the invention as set forth in the claims.

We claim:

1. An insulating textile fabric for use in protective garments of the type commonly worn by fire fighters, said insulating fabric comprising an outer layer of material, an inner layer of material, and an intermediate layer of material sandwiched between said outer and inner layers of material, said intermediate layer of material extending substantially continuously throughout the length and breadth between said inner and outer layers of material and including an array of pleats having a series of alternately oppositely extending peaks extending alternately into engagement with said outer and inner layers of material and maintaining said outer and inner layers of material in mutually spaced relationship, with said pleats of said intermediate layer of materil defining a plurality of air channels between said outer and inner layers of material, spaced lines of stitching extending across said pleats and securing together said outer, intermediate, and inner layers of material along a plurality of spaced paths extending across said air channels and maintaining said intermediate layer of material in position between said outer and inner layers of material and in its pleated configuration between said lines of stitching, and said spaced lines of stitching collapsing together the outer, inner and intermediate layers of material along the lines of stitching.

2. The insulating fabric of claim 1 and wherein said materials are resistant to extremely high temperatures encountered in fighting a fire.

3. The insulating fabric of claim 2 and wherein said outer layer of material comprises woven aramid.

4. The insulating fabric of claim 1 and wherein said stitching has been formed in a quilted pattern in said fabric having intersecting lines of stitching, with said quilted pattern of stitching defining a plurality of contiguous substantially bounded regions of said fabric.

5. The insulating fabric of claim 4 and wherein said stitching has been formed with enough tension to collapse said intermediate layer of material between said outer and inner layers of material at said lines of stitching about said quilted pattern and to substantially isolate the air pockets defined within each of said bounded regions from air pockets within adjacent bounded regions.

6. The insulating fabric of claim 1 and wherein the material of said intermediate layer of material is absorptive for wicking moisture away from said outer layer of material and toward said inner layer of material.

7. The insulating fabric of claim 1 and wherein the materials of said outer, intermediate, and inner layers of material are selected from the group consisting of meta-aramid, polynosic rayon, viscose rayon, acetate, cotton, polyester, polybenzimidazole, polyvinyl alcohol, polytetrafluoroethylene, wool, polyvinyl chloride, polyetheretherketone, polyetherimide, polyethersulfone, polychlal, polyimide, polyamide, polyimideamide, polyolefin, carbon, modacrylic, acrylic, melamine, knits, non-wovens, wovens, stitch bonded fabrics, and weft insertion fabrics.

8. A multi-layered quilted fabric comprising an intermediate of material sandwiched between inner and outer layers of material with said intermediate layer of material having an accordion folded configuration for maintaining said inner and outer layers in mutually spaced relationship at a distance greater than the thickness of said intermediate material, said intermediate layer of material defining a plurality of elongated parallel air channels between said inner and outer layers of material, said inner, outer, and intermediate layers of material being fastened together by spaced lines of stitching that extend across said air channels with said intermediate layer of material being substantially collapsed between said inner and outer layers along the lines of stitching and open between the lines of stitching to form arrays of closed end air channels.

9. The fabric of claim 8 and wherein the material of said outer layer of material is resistant to open flame, the material of said inner layer of material is moisture absorbent, and the material of said intermediate layer of material is adapted to wick moisture away from said outer layer of material and toward said inner a layer of material.

10. A fire fighter's garment comprising:

an outer shell of flame resistant material;

a moisture barrier layer of material positioned adjacent said outer shell;

a thermal lining positioned adjacent said moisture barrier layer of material, said thermal lining comprising an outer layer of material for facing the wearer of the garment, an inner layer of material and an intermediate layer of material positioned between said outer and inner layers of material;

said intermediate layer of material being formed in a series of substantially duplicate accordion folds having fold lines and walls intermediate the fold lines with alternate ones of the fold lines engaging the outer and inner layers of material for maintaining the outer and inner layers of material spaced from each other a distance greater than the thickness of said intermediate layer of material, said intermediate layer of material defining an array of elongated open parallel air channels between said inner and outer layers of material; and fastening means fastening said outer, intermediate and inner layers of material together along spaced lines of connection to maintain the accordion folded configuration of said intermediate layer of material and substantially closing the air channels at intervals along their lengths to form arrays of substantially isolated air channels uniformly distributed about said thermal lining.

11. The firefighter's garment of claim 10 and wherein said intermediate layer of material is substantially collapsed between said inner and outer layers of material along said spaced lines of connection.

12. An insulating textile fabric for use as an inner thermal liner in protective garments of the type commonly worn by firefighters, said insulating fabric comprising an outer layer of material and an accordion folded layer of material juxtaposed said outer layer of material, said accordion folded layer of material including an array of pleats wherein alternate ones of the peaks of the pleats engage with said outer layer of material to maintain said outer layer of material in spaced relationship with any other material adjacent the other side of the folded material, the pleats of said folded layer of material defining a plurality of air channels between said outer and folded layers of material, spaced lines of connection extending across said pleats and securing said outer and folded layers of material together along a plurality of spaced paths extending across said air channels to maintain said folded layer of material in position and in its pleated configuration adjacent said outer layer of material between the lines of connection and to collapse the folded layer of material against said outer layer of material along the spaced paths and form at least some of said air channels into closed end channels.

13. The insulating textile fabric of claim 12 and wherein said outer layer of material comprises woven aramid.

14. The insulating textile fabric of claim 12 and wherein said spaced lines of connection comprise stitching applied through said outer and folded layers of material.

15. The insulating textile fabric of claim 14 and wherein said stitching comprises intersecting lines of stitching in a quilted pattern in said fabric with said quilted pattern defining a plurality of contiguous substantially bounded regions of said fabric.

16. The insulating textile fabric of claim 15 and wherein said stitching has been formed with tension sufficient to collapse said intermediate layer of material against said outer layer of material at said lines of stitching about said quilted pattern and to substantially isolate the air pockets defined within each of said bounded regions from air pockets within adjacent bounded regions.

17. The insulating textile fabric of claim 12 and wherein said folded layer of material is absorptive for wicking moisture away from said outer layer of material.

18. The insulating textile fabric of claim 12 and wherein the materials of said outer and intermediate layers of material are selected from the group consisting of meta-aramid, polynosic rayon, viscose rayon, acetate, cotton, polyester, polybenzimidazole, polyvinyl alcohol, polytetrafluoroethylene, wool, polyvinyl chloride, polyetheretherketone, polyetherimide, polyethersulfone, polychlal, polyimide, polyamide, polyimideamide, polyolefin, carbon, modacrylic, acrylic, melamine, knits, non-wovens, wovens, stitch bonded fabrics, and weft insertion fabrics.

19. A multi-layered quilted heat insulating textile fabric comprising an accordion folded layer of material arranged in overlying relationship with an outer layer of material, said folded layer of material defining a plurality of elongated parallel air channels between said folded and outer layers of material, spaced lines of stitching fastening together said folded and outer layers of material, said stitching extending across said air channels with said folded layer of material being substantially collapsed by said stitching against said outer layer of material along the lines of stitching and open between the lines of stitching to form arrays of substantially isolated air pockets between said folded and outer layers of material and between the lines of stitching.

20. The fabric of claim 19 and wherein the material of said outer layer of material is resistant to open flame, and the material of said folded layer of material is absorptive for wicking moisture away from said outer layer of material.

21. A firefighter's garment comprising:

an outer shell of flame resistant material;

a moisture barrier layer of material positioned adjacent said outer shell;

a thermal lining positioned adjacent said moisture barrier layer of material, said thermal lining comprising an outer layer of material for facing the wearer of the garment and an accordion folded layer of material, said folded layer of material juxtaposed said moisture barrier material;

said folded layer of material being formed in a series of substantially duplicate accordion folds having fold lines and walls intermediate the fold lines with alternate ones of the fold lines engaging the outer layer of material for maintaining the outer layer of material spaced from said moisture barrier material a distance greater than the thickness of said intermediate layer of material, said intermediate layer of material defining an array of elongated open parallel air channels adjacent said outer layer of material; and fastening means fastening said outer and folded layers of material together along spaced lines of connection to maintain the accordion folded configuration of said folded layer of material between the spaced lines of connection and to substantially collapse the folded layer of material against the outer layer of material and to close the air channels at intervals along their lengths at the spaced lines of connection to form arrays of elongated closed end air pockets uniformly distributed about said thermal lining.

* * * * *